US005373299A

United States Patent [19]

Ozaki et al.

[11] Patent Number: 5,373,299

[45] Date of Patent: Dec. 13, 1994

[54] LOW-PROFILE WIDEBAND MODE FORMING NETWORK

[75] Inventors: Ernie T. Ozaki, Poway; Robert G. Riddle, Escondido; John D. Voss, San Diego, all of Calif.

[73] Assignee: TRW Inc., Redondo Beach, Calif.

[21] Appl. No.: 65,850

[22] Filed: May 21, 1993

[51] Int. Cl.[5] ..... H01Q 3/26

[52] U.S. Cl. ..... 342/373; 333/116; 333/246

[58] Field of Search ..... 333/116, 128, 238, 246; 342/373

[56] References Cited

U.S. PATENT DOCUMENTS

| | | | |
|---|---|---|---|
| 3,691,563 | 9/1972 | Shelton | 333/238 X |
| 3,740,678 | 6/1973 | Hill | 333/238 |
| 3,777,284 | 12/1973 | Schultz | 333/116 |
| 3,867,759 | 2/1975 | Siefker | 333/238 X |
| 4,424,500 | 1/1984 | Viola et al. | 333/128 |
| 4,812,792 | 3/1989 | Leibowitz | 333/238 |
| 5,132,648 | 7/1992 | Trinh et al. | 333/128 |
| 5,134,417 | 7/1992 | Thompson | 342/373 X |

FOREIGN PATENT DOCUMENTS

| | | | |
|---|---|---|---|
| 232502 | 9/1988 | Japan | 333/128 |

*Primary Examiner*—Paul Gensler

*Attorney, Agent, or Firm*—R. W. Keller; G. G. Schivley

[57] ABSTRACT

A low-profile multioctave frequency band microwave mode forming network is provided which includes a plurality of circuit layers having circuitry for receiving M feed signals which may provide M beams or modes of operation. Each circuit layer has a dielectric board with circuitry formed on top and bottom surfaces thereof and is sandwiched between top and bottom dielectric layers to form a tri-plate stripline circuitry. The circuit layers are dielectrically isolated from one another and further separated by conductive ground planes. The circuitry includes a plurality of couplers, phase shifters and transmissions lines which do not require transmission line cross-overs on any given surface. A plurality of right-angle RF interconnects are included for providing electrical connection to the circuitry. Output ports are provided for coupling said feed network to N elements of an antenna system.

20 Claims, 9 Drawing Sheets

LOW-PROFILE WIDEBAND MODE FORMING NETWORK

This invention herein described has been made in the course of or under U.S. Government Contract No. F33615-90-C-1448 or a subcontract thereunder with the Department of Air Force.

BACKGROUND OF THE INVENTION

1. Technical Field

This invention relates generally to stripline microwave antenna feed systems and, more particularly, to a compact low-profile wideband microwave antenna mode forming network such as a Butler matrix.

2. Discussion

Microwave antenna feed systems are generally known for directly feeding the input: and/or output ports of a multiple-port antenna system so as to achieve multiple antenna beam and/or mode control. One class of microwave antenna feed systems are commonly known as Butler matrices. Currently, Butler matrices are used in conjunction with airborne microwave electronic warfare and communication systems for purposes of providing instantaneous direction finding and multibeam jamming of microwave signals A conventional Butler matrix generally feeds (N) feed elements of a multi-port antenna system and provides the ability to operate with (M) radiating modes or beams. A typical Butler matrix generally includes a number of 90 or 180 degree hybrid couplers along with a number of fixed phase shifters which are usually electrically interconnected via phase-trimmed coaxial cables.

Currently, commercially available Butler matrices include the ninety degree (90°) type manufactured by Anaren which is located in, Syracuse, N.Y. and having Model Nos. 182570 and 182580. These particular Butler matrices include eight (N=8) antenna ports and eight (M=8) receive/transmit ports and are capable of providing simultaneous multiple beam transmission and/or receiving bearing information. However, such commercially available Butler matrix mode forming networks generally involve a rather large, heavy and complex packaging arrangement, especially those networks which are capable of providing a large number of beams.

The complex packaging associated with prior networks typically includes a large number of electrical components arranged in a bulky layout and coupled to one another by way of cross-over transmission lines. Typical circuit layouts further require multilayer signal interconnections which may become unwieldy and cause the feeds to exhibit high insertion loss due to ohmic and mismatch loss. In addition, the commercially available Butler matrix networks are generally capable of operating effectively over a very limited frequency range. For instance, typical operating ranges include frequencies between 7–15 GHz or 12–18 GHz. Such limited frequency ranges are usually rather narrow and generally do not extend into higher frequencies such as those exceeding 20 GHz.

Current and future trends in airborne electronic warfare and communication technologies require that Butler matrices provide increasingly wider instantaneous bandwidths. For instance, there is an increasing need to achieve multioctave performance up to Ku band frequencies and above so as to allow for operation across, the entire microwave band. In addition, there is an increasing need to provide for a larger number of antenna modes or beams in a smaller more light weight package. Furthermore, it is desirable to decrease the costs associated with manufacturing Butler matrices such as the costs generally involved in attempting to meet stringent cable phase-trimming requirements.

It is therefore desirable to provide for an improved low-profile Butler matrix modeforming network which is capable of operating over wide instantaneous bandwidths. More particularly, it is desirable to provide for such a Butler matrix network which exhibits high frequency multioctave operating capabilities. In addition, it is desirable to provide for a Butler matrix modeforming network which is capable of providing a large number of antenna modes in a small lightweight package which exhibits rather low energy loss.

SUMMARY OF THE INVENTION

In accordance with the teachings of the present invention, a low-profile muitiple simultaneous microwave mode forming network is provided which exhibits multioctave frequency band operations. The network includes a plurality of circuit layers which include triplate stripline circuitry formed on top and bottom surfaces thereof. The circuit layers are dielectrically isolated from one another and further separated by conductive ground planes. The circuitry includes a plurality of couplers, phase shifters and transmissions lines which do not require transmission line cross-overs on any given surface. A plurality of right-angle RF interconnects are included for providing electrical connection to the circuitry.

BRIEF DESCRIPTION OF THE DRAWINGS

Other objects and advantages of the present invention will become apparent to those skilled in the art upon reading the following detailed description and upon reference to the drawings in which.

Figure 11:
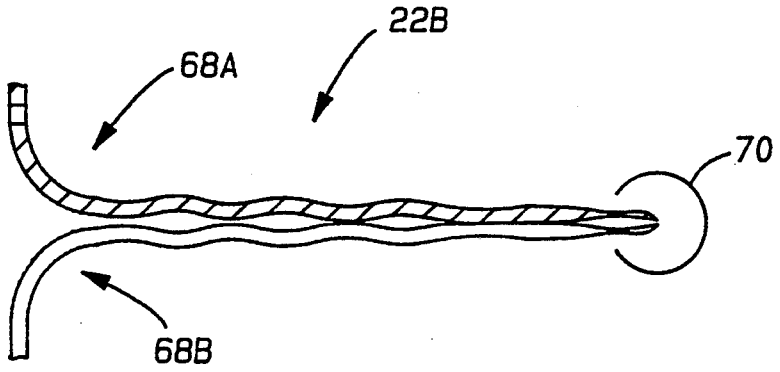
FIG. 11 is an enlarged view of a forty-five degree phase shifter used in accordance with the present invention.
Figure 13:
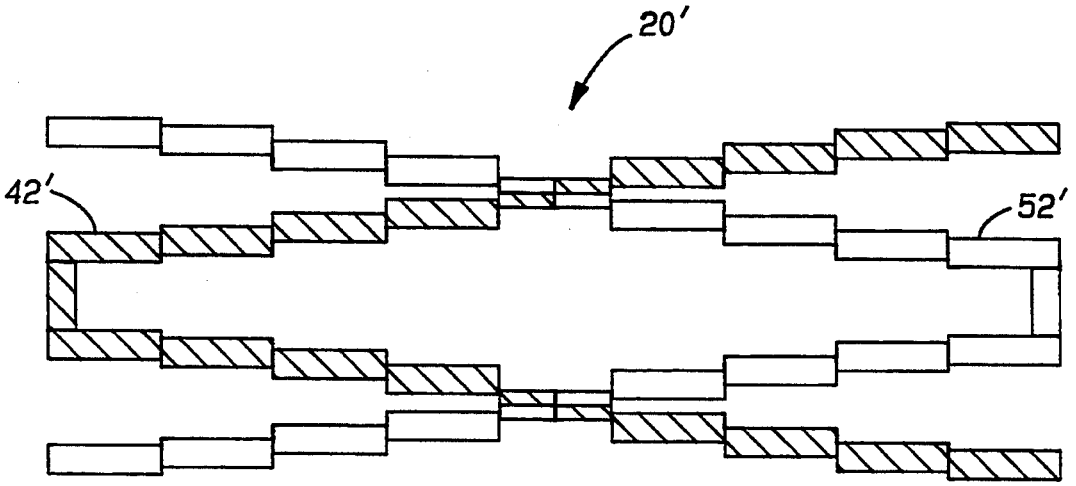
Figure 14:
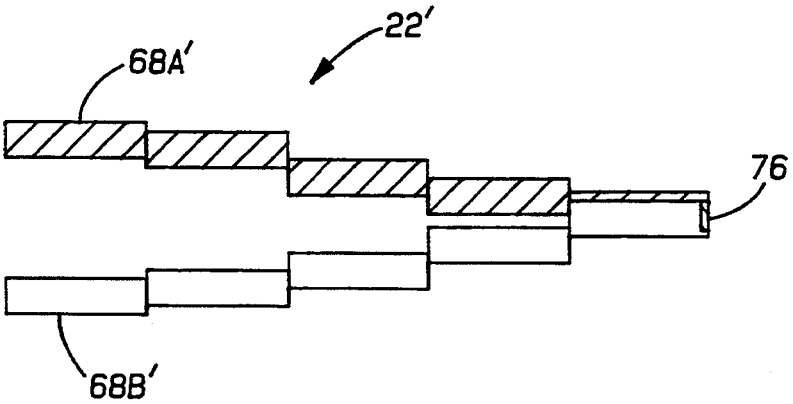

FIG, 12 is an enlarged view of a portion of the phase shifter taken from a section shown in FIG. 11;

FIG. 13 is a stepped prototype representation of a ninety degree hybrid coupler taken from a top view in accordance with an alternate embodiment of the present invention; and FIG. 14 is a stepped prototype representation of a forty-five degree phase shifter taken from a top view in accordance with an alternate embodiment of the present invention.

DETAILED DESCRIPTION OF THE PREFERRED EMBODIMENTS

Figure 1:
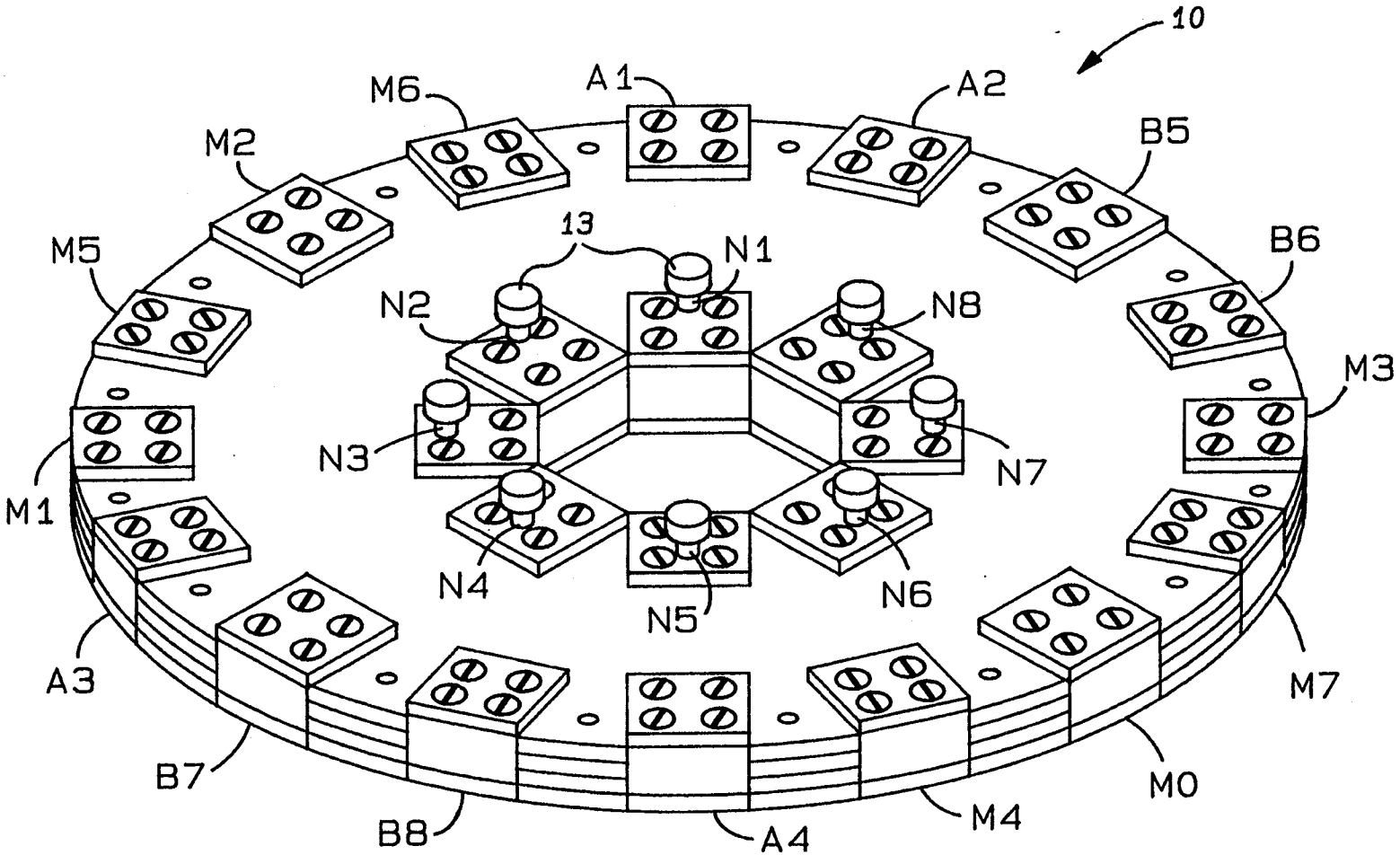
FIG. 1 is a schematic representation of a low-profile Butler matrix microwave antenna feed system in accordance with the present invention.

Turning now to FIG. 1, a Butler matrix microwave antenna feed system 10 is shown therein in the form of a compact low-profile structure that is achieved by way of the present invention. The Butler matrix 10 includes a multi-layer architecture packaged in a unique low-profile disk-shaped structure 11 which encloses a low energy loss multi-layer circuit arrangement. The Butler matrix 10 is described herein according to an 8×8 matrix example. That is, Butler matrix 10 generally operates to feed up to N=8 elements of an antenna and provides up to M=8 radiating modes or beams. However, while the Butler matrix is described according to an 8×8 Butler matrix, the present invention may generally be employed to achieve any M×N Butler matrix antenna feed system.

The Butler matrix 10 includes a plurality of evenly spaced outer RF electrical interfaces or interconnects A1 through A4, B5 through B8 and M0 through M7 located along the outer perimeter of structure 11. In addition, a plurality of evenly spaced inner RF electrical interfaces N1 through N8 are located along an inner portion of structure 11. RF electrical interfaces M0 through M7 and N1 through N8 allow for electrical connection to input/output devices, while interfaces A1 through A4 and B5 through B8 provide high performance electrical interconnection between circuity located on a plurality of circuit layers as described hereinafter.

Figure 2:
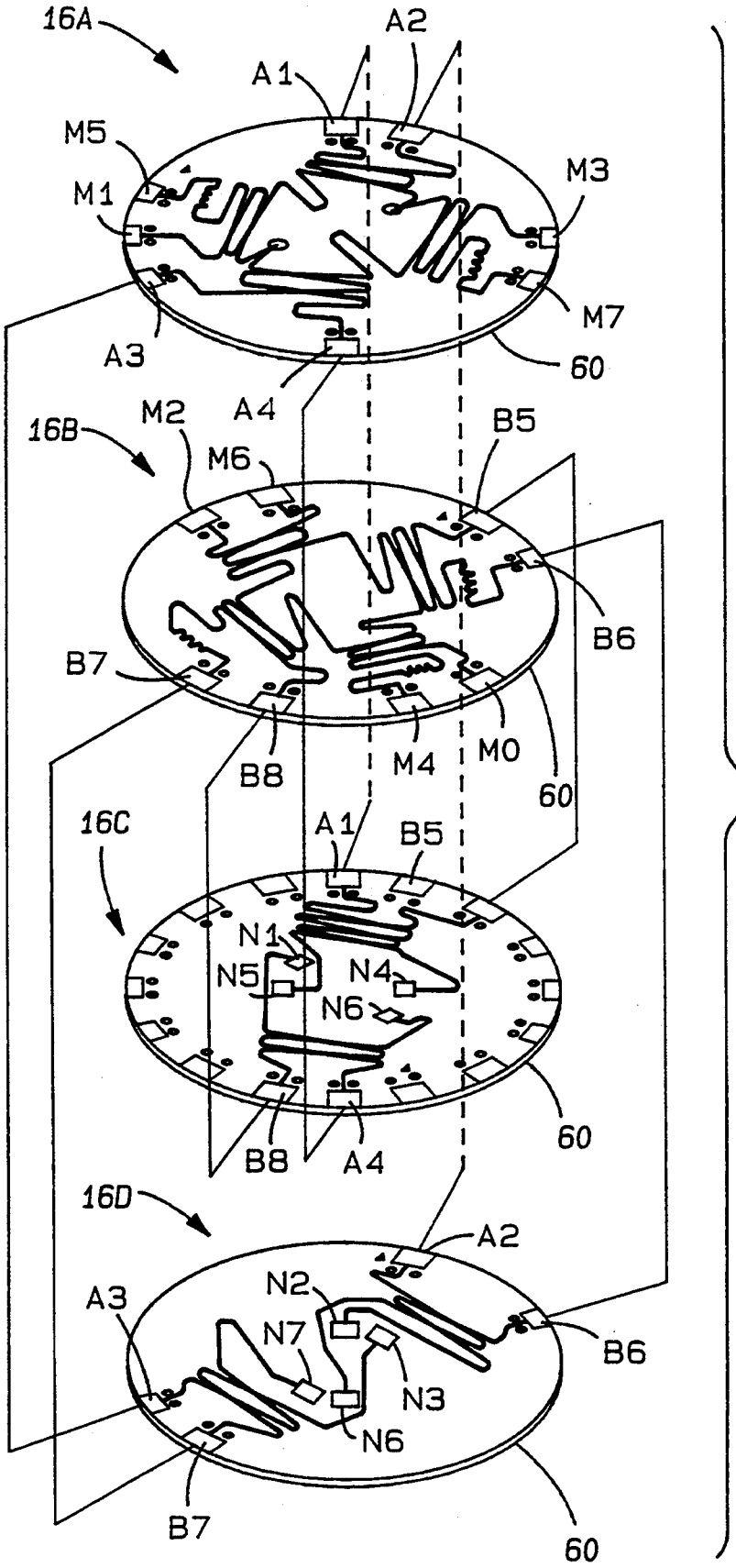
FIG. 2 is an exploded view of the circuit layers included in the Butler matrix according to the present invention.
Figure 7:
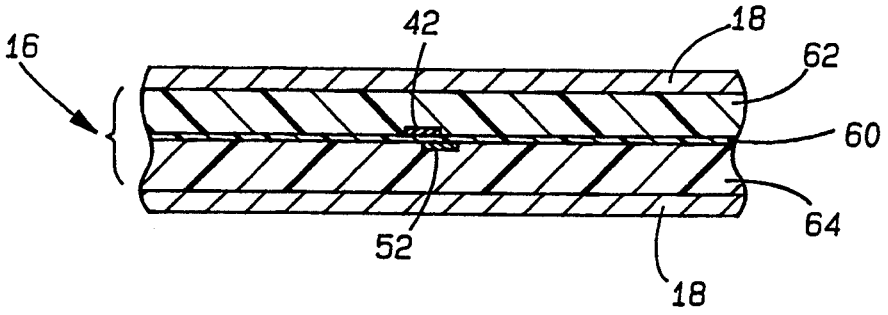
FIG. 7 is a cross-sectional view of a portion of the circuitry formed on layer A of the Butler matrix according to the present invention.

The Butler matrix antenna feed system 10 described herein includes four tri-plate circuit layers 16A through 16D stacked one above the other as shown in FIG. 2. Each of circuit layers 16A through 16D includes a shim dielectric board 60 which has electrical circuitry formed on both the top and bottom surfaces thereof. The circuitry is preferably formed on the shim dielectric board 60 through the implementation of print and etch techniques which are well known throughout the art. As shown in FIG. 7 and described in more detail below, the shim dielectric board 60 is sandwiched between top and bottom dielectric layers 62 and 64, which together form the tri-plate layering arrangement.

According to the present invention, the circuitry includes an array of transmission lines formed on the top and bottom surface of each of circuit layers 16A through 160 which do not overlap one another on any given surface. This is in contrast conventional Butler matrix architectures where the component layout generally requires transmission line overlaps such as air bridges or coax cable line crossovers. Previously employed transmission line overlaps typically lead to a rather narrow bandwidth due to poor isolation and match characteristics in addition to costly fabrication techniques. By implementing a plurality of thin circuit layers 16A through 16D as described herein, the need for air bridge crossovers is effectively eliminated so as to achieve a more low-profile circuit configuration which offers a wide frequency band of operation, while maintaining low energy losses.

Figure 3:
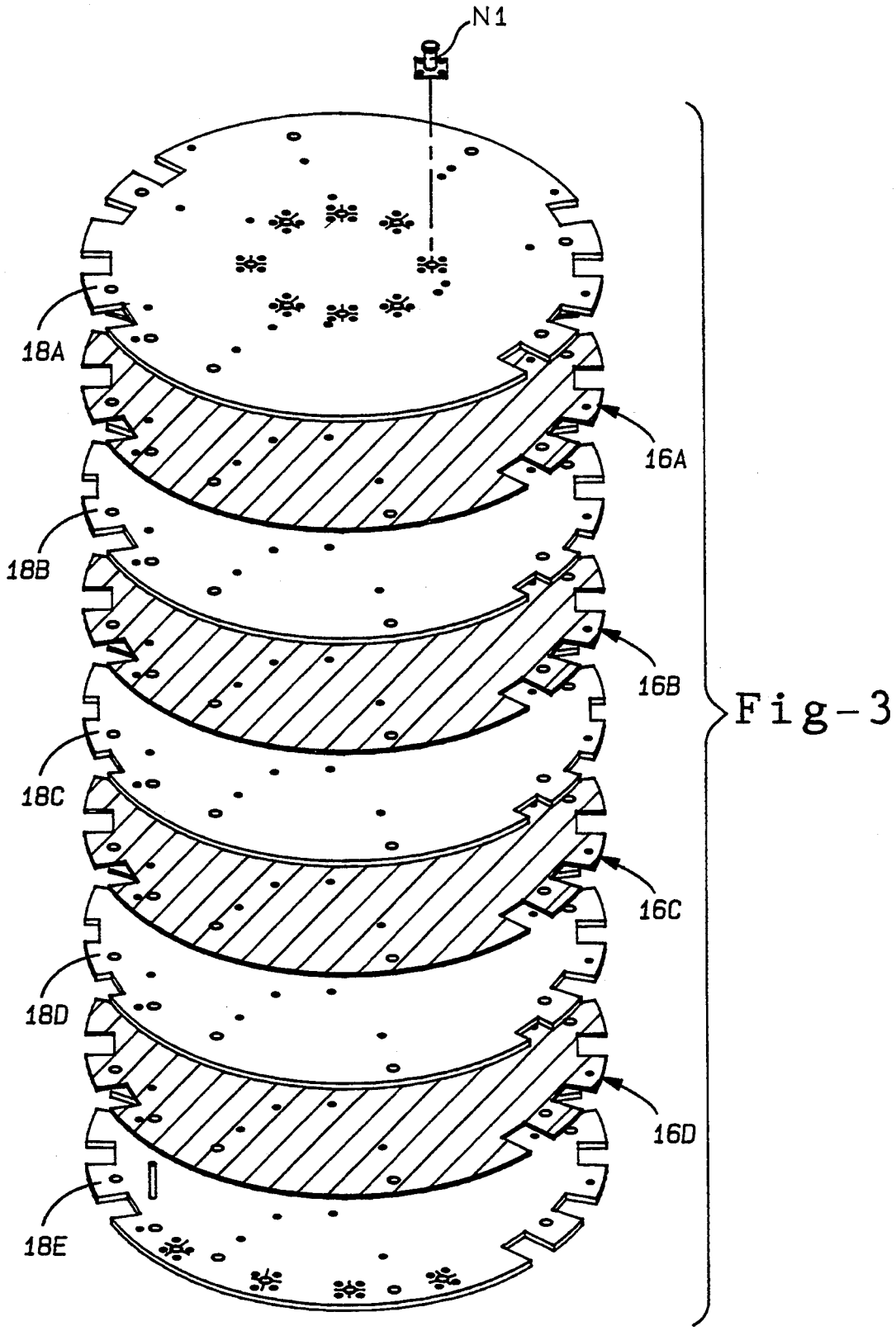
FIG. 3 is an exploded view of the circuit layers and ground plane layers included in the Butler matrix according to the present invention.

The plurality of circuit layers 16A through 16D are dielectrically separated and electrically isolated from one another. Each of the dielectric shim boards 60 and associated top and bottom circuitry have a first dielectric layer disposed on the top surface thereof and a second dielectric layer disposed on the bottom surface thereof to form the tri-plate stripline circuitry configuration. In addition, adjacent circuit layers are further separated from one another by way of conductive ground planes formed by conductive ground plates 18A through 1BE as shown in FIG. 3. Conductive plates 18A through 18E are grounded and are preferably electrically coupled to one another via the RF interconnects 30 which are described hereinafter so as to form a ground plane substantially surrounding each of circuit layers 16A through 16D. The ground plan thereby operates so as to isolate each of the signal layers and thereby enhance signal operations, which is especially desirable for high frequency signals.

Figure 4:
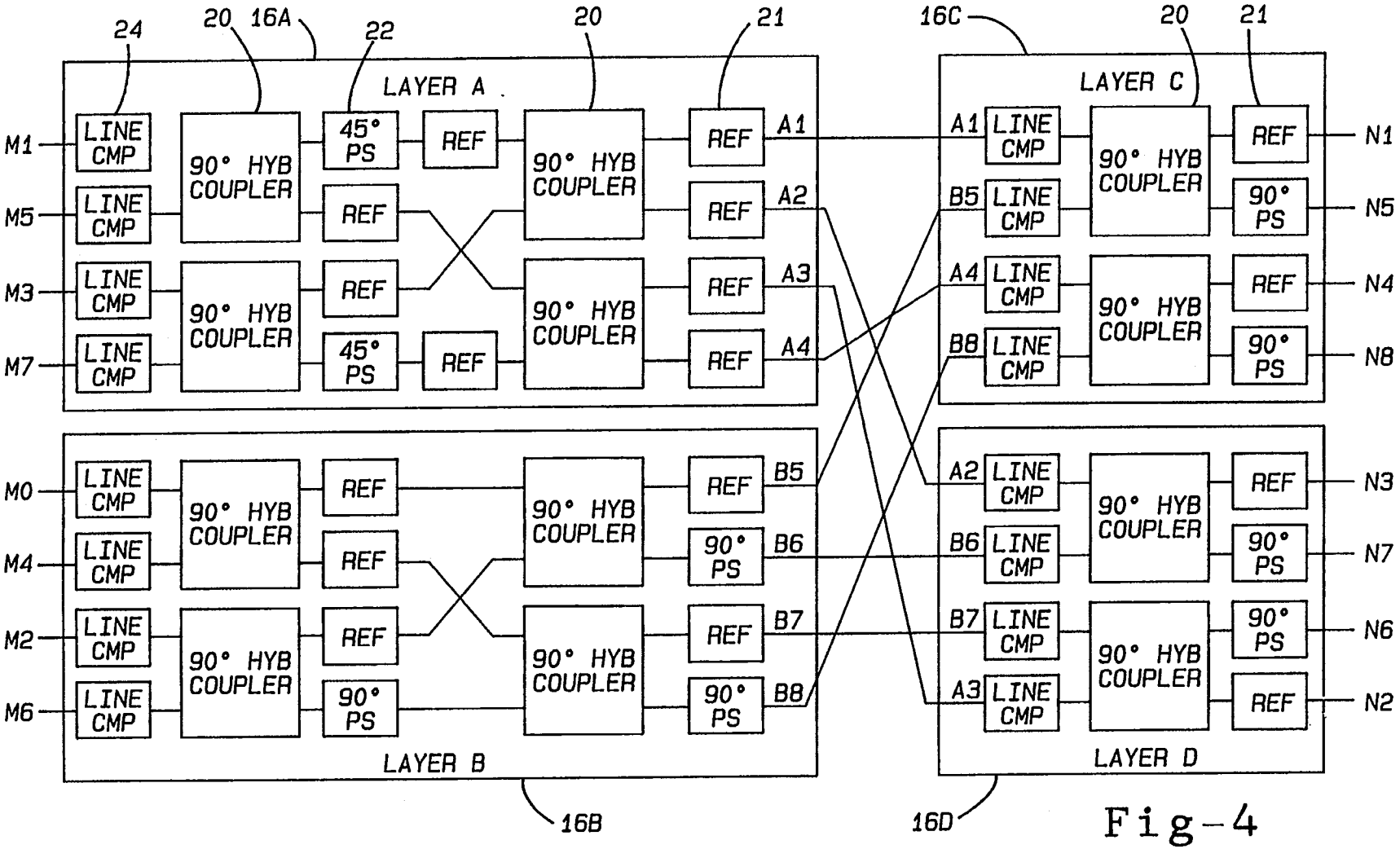
FIG. 4 is a block diagram which illustrates the electrical circuitry according to circuit layer of the Butler matrix.

The circuit configuration for the 8×8 Butler matrix feed system 10 is shown represented in block diagram form for each of circuit layers 16A through 16D as provided in FIG. 4. According to the 8×8 Butler matrix example described herein, twelve ninety degree (90°) hybrid couplers 20, a plurality of fixed phase shifters 22, reference lines 21, line compensators 24 and the RF interconnects are included. A plurality of mode input ports are provided by RF interfaces M0 through M7 which in turn are coupled to a first plurality of the line compensators 24 on circuit layers 16A and 16B. The mode input ports M0 through M7 are preferably electrically coupled to M receiver ports 12, as shown in FIG. 1, for receiving M radiating modes or beams.

Circuit layers 16A and 16B each include a first pair of 90° hybrid couplers 20 coupled to a pair of the line compensators 24. Each 90° hybrid coupler has a pair of outputs coupled to a plurality of reference lines 21 and phase shifters 22 that :n turn feed a second pair of 90° hybrid couplers 20 which likewise have a pair of outputs coupled to either of additional reference lines 21 or phase shifters 22. Circuit layers 16A and 16B further include a plurality of circuit layer output lines which are coupled to a plurality of circuit layer input lines found on circuit layers 16C and 16D through the RF interconnects A1 through A4 and B5 through B8.

Circuit layers 16C and 16D each include a second plurality of line compensators 24 which are coupled to RF interconnects A1 through A4 and B5 through B8. Each of circuit layers 16C and 16D includes a pair of 90° hybrid couplers 20 which have a pair of inputs coupled to the line compensators 24. The 90° hybrid couplers 20 in turn have outputs coupled to reference lines 21 and phase shifters 22. Circuit layers 16C and 16D further include a plurality of antenna output ports 13, as shown in FIG. 1, which are provided through RF interfaces N1 through N8 which are coupled to N antenna elements, such as N arms associated with an N element spiral antenna. Accordingly, the N antenna elements may transmit and/or receive energy based on M operating modes or beams.

Figure 5:
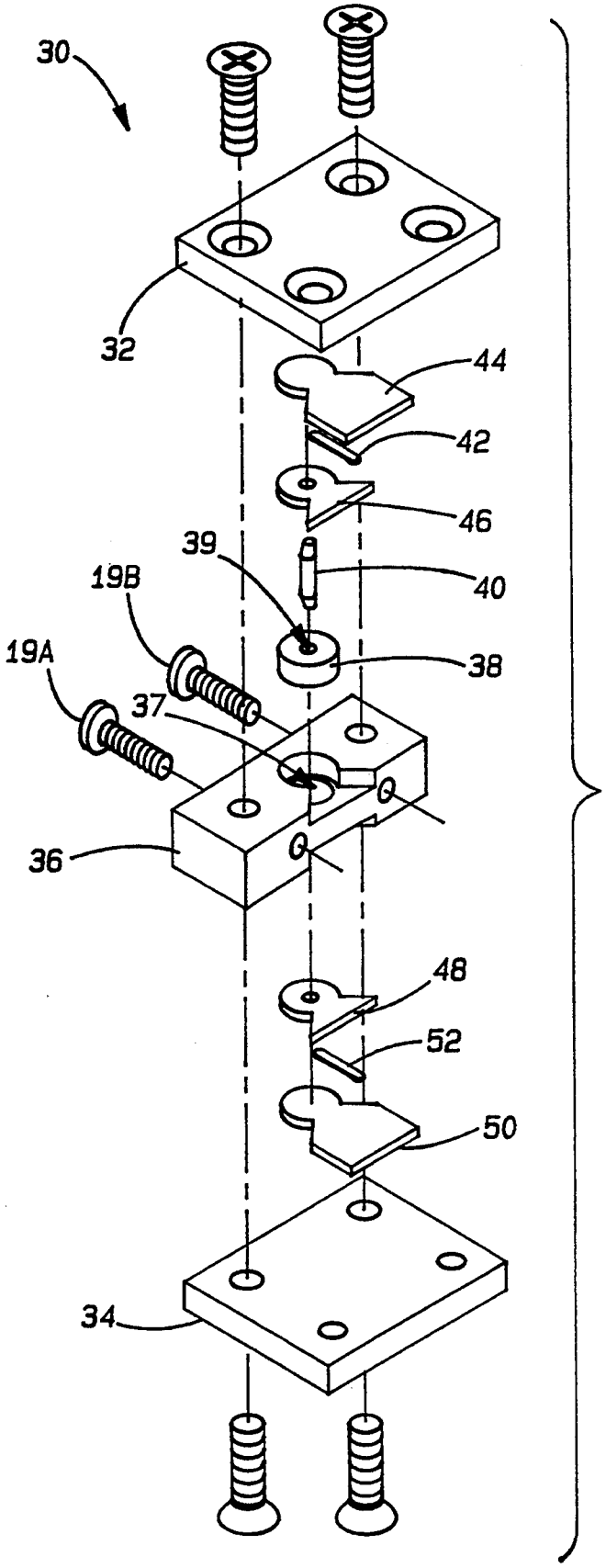
FIG. 5 is an exploded view of an RF interconnect as employed in conjunction with the Butler matrix according to the present invention.

The present invention employs a plurality of high frequency low loss right-angle RF signal interconnects 30 of the type shown in FIG. 5. The RF interconnect 30 is described in detail in a patent application filed on Apr. 1, 1993, entitled "Wideband Solderless Right-Angle RF Interconnect" and having U.S. Ser. No. 08/042,565. The subject of this patent application is a common assignee and is incorporated by reference herein. In particular, the RF interconnects A1 through A4 and B5 through B8 of the present invention include the layer-to-layer signal interconnect shown in FIG. 3 of the above-incorporated patent application and further shown in FIG. 5 herein as represented by interconnect 30.

According to FIG. 5 of the present application, interconnect 30 includes top and bottom aluminum plates 32 and 34 which are secured onto the top and bottom surfaces of a conductive housing 36. Conductive housing 36 has a passage 37 formed therein in which an insulation tube 38 is disposed. Insulation tube 38 has a passage 39 through which a conductive pin 40 is located which extends between a first circuit trace 42 and a second circuit trace 52. The first circuit trace 42 is disposed between an upper dielectric layer 44 and a lower dielectric layer 46, while the second trace 52 is likewise disposed between an upper dielectric layer 48 and a lower dielectric layer 50.

Both ends of conductive pin 40 have triple-tapered edges formed thereon which operate to enhance signal transitions provided therewith, especially for high frequency signals. The triple-tapered edges are properly arranged to advantageously provide for increased performance high frequency signal transitions between the first and second circuit traces 42 and 52. In addition, conductive pin 40 has an opening formed in each end with a springy conductive button lodged therein and extending outward therefrom as disclosed in the above-incorporated application. Accordingly, conductive pin 40 is sandwiched between signal traces 42 and 52 so as to provide a high performance right-angle electrical interconnection between selected pairs of circuit layers.

The remaining RF interconnects M0 through M7 and N1 through N8 provide electrical interconnections between one of circuit layers 16A through 16D and an external input/output device. Interconnects M0 through M7 and N1 through N8 include the type disclosed in detail in FIGS. 1 and 2 of the above-incorporated application. Accordingly, interconnects M0 through M7 and N1 through N8 may accommodate a coaxial cable to signal trace interconnection.

In addition, a pair of horizontal fasteners 19*a* and 19*b* fasten each associated RF interconnect 30 to structure 11 so that pressurized contact is provided between the conductive portions thereof and conductive layers 18A through 18E. That is, electrical contact is provided between conductive plates 32 and 34, fasteners 19*a* and 19*b* and conductive ground plates 18A through 18E. Accordingly, ohmic contact is formed around each of the circuit layers 16A through 16D such that a uniform conductive ground plane is provided by conductive return paths.

Figure 6:
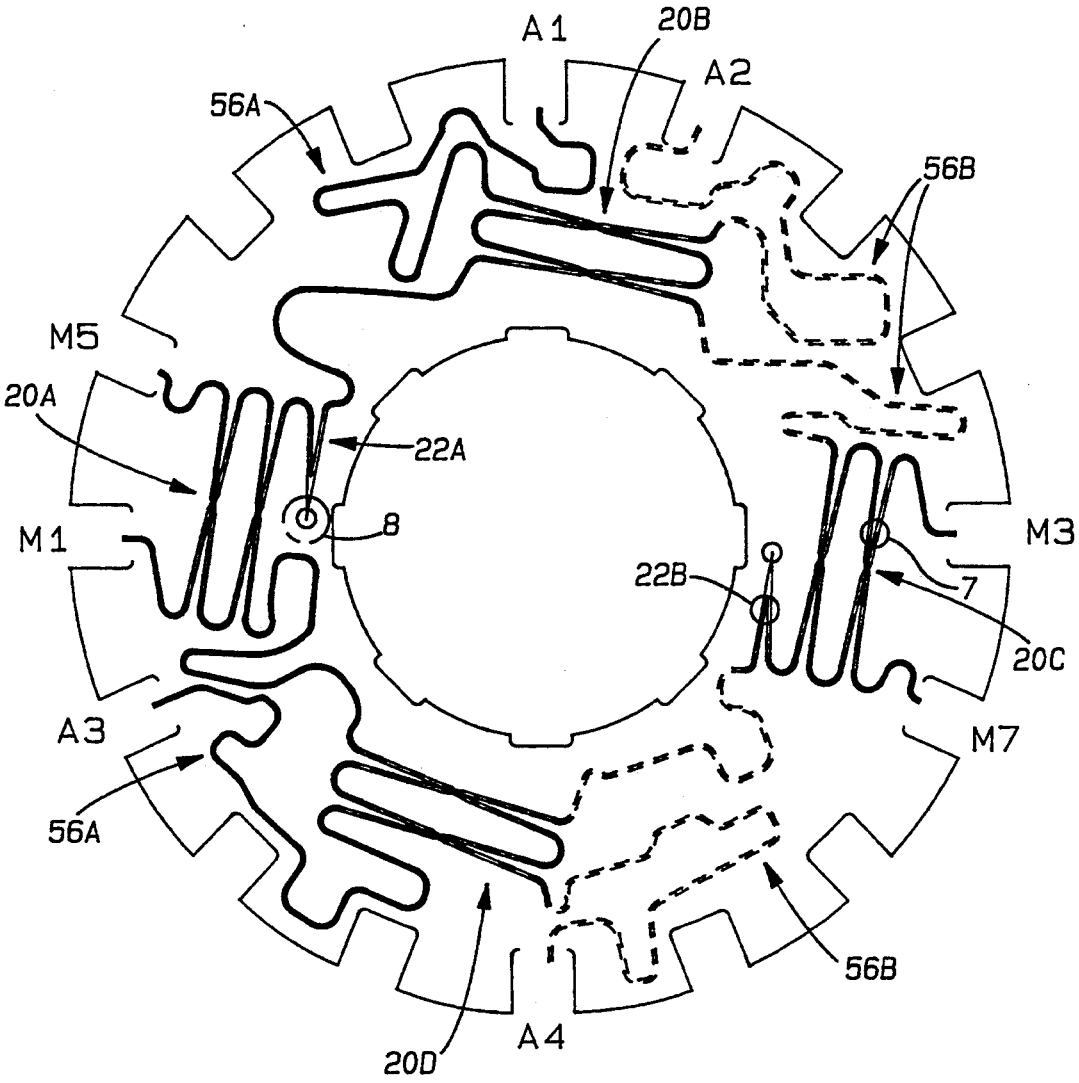
FIG. 6 is a circuit layout which illustrates the top and bottom circuitry located on layer A of the Butler matrix.

With particular reference to FIG. 6, the circuit architecture provided on the first circuit layer 16A is shown in detail therein. First circuit layer 16A includes four ninety-degree (90°) hybrid couplers 20A through 20D and a pair of phase shifters 22A and 22B, which are electrically coupled via transmission lines 56A and 56B, Transmission lines 56A are formed on the top surface of dielectric shim board 60, while transmission lines 56B are formed on the bottom surface of board 60. The circuit configuration of circuit layer 16A further includes electrical transmission lines leading to mode input ports provided by interconnects M1, M3, M5 and M7 as well as output ports provided by interconnects A1 through A4 for electrical connection to circuitry located on circuit layers 16C and 16D.

The present invention advantageously employs both the top and bottom surfaces of the dielectric shim board 60 forming circuit layers in such a manner which avoids single surface transmission line crossovers. While FIG. 6 shows the electrical arrangement for circuit layer 16A, the remaining circuit layers 16B through 16D likewise have a similar architecture which incorporate the teachings of the present invention but are not shown herein in order to avoid unnecessary duplication.

The circuit layers 16A through 16D are each formed in a tri-plate configuration as illustrated by a cross-sectional portion thereof provided in FIG. 7. The dielectric shim board 60 has a top circuit layer 42 and a bottom circuit layer 52 formed thereon. Dielectric shim board 60 is disposed between a top dielectric layer 62 and a bottom dielectric layer 64. The ground plates 18 as previously discussed are then disposed on the top of dielectric layer 62 and bottom of dielectric layer 64. Accordingly, circuit traces 42 and 52 form stripline circuitry offset from one another and separated by dielectric shim board 60.

Figure 9:
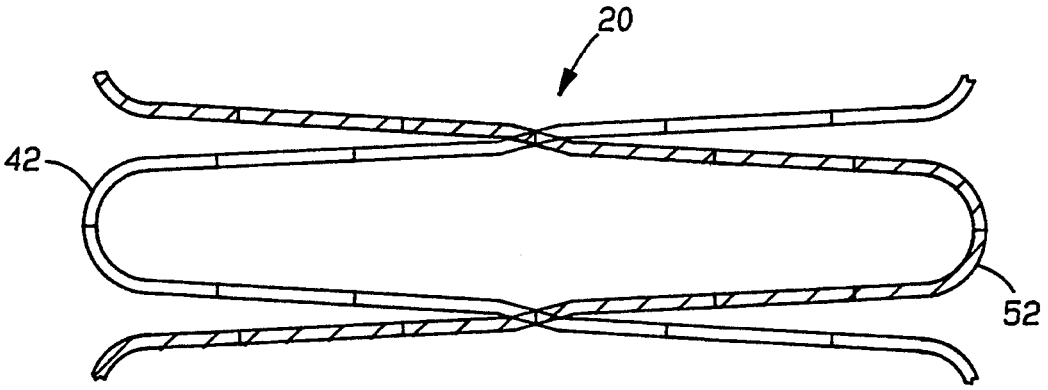
FIG. 9 is an enlarged view of a ninety degree hybrid coupler used in accordance with the present invention.
Figure 10:
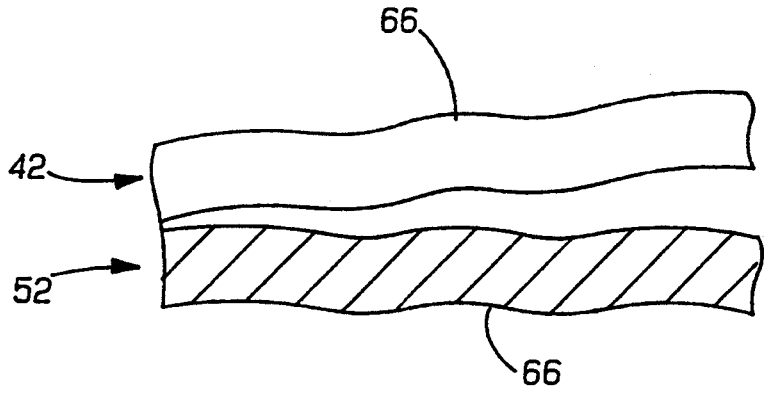
FIG. 10 is an enlarged view of a portion of the hybrid coupler taken from a section shown in FIG. 9.

The cross-sectional portion of circuit layer 16 described above is taken from section 7 of FIG. 6, which includes a portion of ninety degree hybrid coupler 20C. The ninety degree hybrid coupler 20 is further shown in detail in FIG. 9 from a top view. Coupler 20 includes a top U-shaped circuit trace 42 formed above and overlapping the bottom U-shaped circuit trace 52. The top and bottom circuit traces 42 and 52 forming coupler 20 have edges formed with undulations 66 which are shown in the enlarged view of section 7 as provided in FIG. 10. The undulations 66 enhance the high frequency transmission therethrough by minimizing internal reflections which would otherwise occur with conventional stepped transmission line equivalents. This allows for a higher frequency range of operation.

Figure 12:
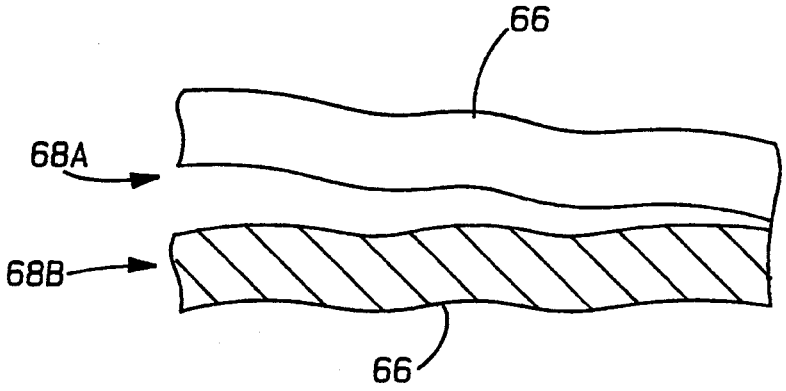

FIG. 11 illustrates a top view of a phase shifter 22B which includes a top circuit trace 68A and a bottom circuit trace 68B leading to a mode suppression ring 70. The circuitry forming phase shifter 22B is arranged so that a predetermined phase shift, i.e. forty-five degrees, may be achieved by way of signal interference. To achieve phase shifts of greater than forty-five degrees, the above-described circuitry may be cascaded (i.e., cascaded in series) to produce multiples thereof such as ninety degrees, one-hundred-thirty-five degrees, etc. A portion of phase shifter 22 is shown in an enlarged view in FIG. 12. Accordingly, phase shifter 22 likewise includes edges formed with undulations 66 which minimize internal reflections that would otherwise occur with conventional stepped transmission line equivalents and further enhance the high frequency and wideband frequency performance.

Figure 8:
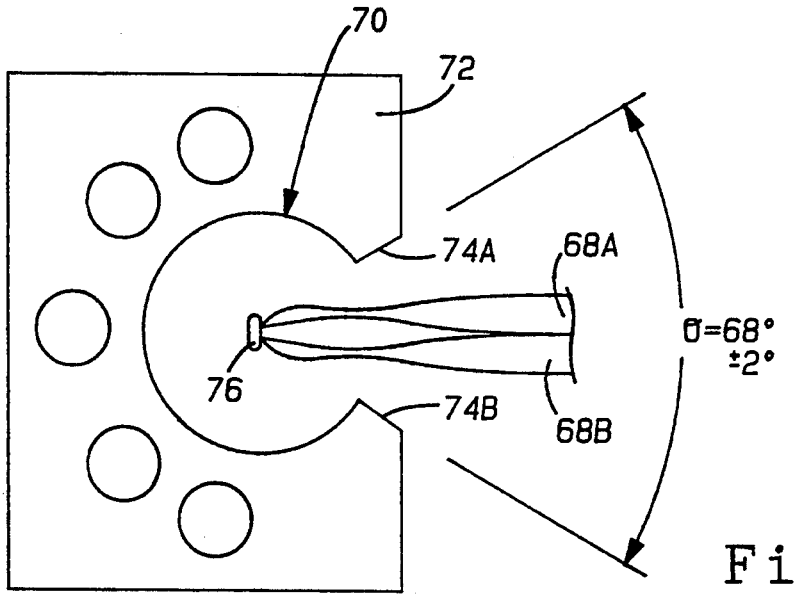
FIG. 8 is a top view of a phase shifter mode suppression ring in accordance with the present invention.

The mode suppression ring 70 is shown in detail in FIG. 8. The mode suppression ring 70 has a conductive structure 72 disposed within the dielectric shim board 60 with a cylindrical passage formed therein and flanged edges 74A and 74B extending therefrom at approximately a sixty-eight degree angle. The mode suppression ring 70 effectively terminates the unwanted higher-order modes of electro-magnetic wave propagation, that is, modes others than transverse electric magnetic (TEM). A conductive ribbon 76 is located within the passage between the bottom trace 68B and top circuit trace 68A and which shorts the two ends of the top and bottom traces 68A and 68B together. This effectively shorts out the odd-mode impedance component of the electro-magnetic wave. The geometry of the opening and flanged angle enable one to achieve enhanced monotonic phase and amplitude distribution over a wideband range of frequencies.

In accordance with alternate embodiments of the present invention, a stepped ninety degree hybrid coupler 20' is shown in FIG. 13 and a stepped forty-five degree phase shifter 22' is shown in FIG. 14. The stepped coupler 20' includes overlapping stepped U-shape top and bottom circuit traces 42' and 52' with a stepped pattern. The stepped phase shifter 22' includes a stepped pattern top circuit trace 68A' overlapping a stepped pattern bottom circuit trace 68B'. According to these alternate arrangements, the stepped coupler 20' and phase shifter 22' provide a selected phase shift without the requirements of undulations 66.

In operation, the low-profile Butler matrix microwave antenna feed system 10 may be advantageously employed to control the transmission or reception of a radiating beam for an antenna system. In doing so, the feed system 10 is connected to a multiple element antenna system so that RF interfaces N1 through N8 are coupled to N elements of the antenna. RF interfaces M0 through M7 are coupled to M ports of a transmitter/-receiver device. Accordingly, the transmitter/receiver device may controllably transmit radiation according to M modes or antenna beams. Likewise, the transmitter/-receiver device may receive radiation and derive information therefrom which may include bearing data according to M0 through ML modes or beams, where L is an integer equal to 1,2, . . . N−1, and N is the number of antenna elements. According to the present invention, one may achieve multioctave frequency band performance with at least a ten-to-one ratio or higher.

In view of the foregoing, it can be appreciated that the present invention enables the user to achieve a low profile wideband mode forming network such as the Butler matrix described herein. Thus, while this invention has been disclosed herein in combination with a particular example thereof, no limitation is intended thereby except as defined in the following claims. This is because a skilled practitioner recognizes that other modifications can be made without departing from the spirit of this invention after studying the specification and drawings.

What is claimed is:

1. A low-profile microwave antenna modeforming feed network comprising:

input means coupled to a plurality of stacked circuit layers for receiving M feed control signals;

said plurality of stacked circuit layers having electrical circuitry formed thereon, each circuit layer including a dielectric board having circuitry formed on top and bottom surfaces thereof, said electrical circuitry provided in an offset coupled arrangement;

first and second dielectric layers disposed on the top and bottom surfaces, respectively, of each dielectric board and the associated circuitry so as to form a low-profile tri-plate circuit arrangement;

a conductive ground plane formed between each of said tri-plate circuit arrangements and isolated therefrom;

interconnect means for providing electrical connections between the electrical circuitry on different circuit layers; and output means coupled to said plurality of stacked circuit layers for communicating with N feed elements.

2. The network as defined in claim 1 wherein said electrical circuitry comprises a plurality of couplers, phase shifters and transmission lines forming a feed matrix.

3. The network as defined in claim 1 wherein said electrical circuitry on each of said circuit layers comprises single layer microwave stripline circuit traces which do not overlap one another on any given surface.

4. The network as defined in claim 1 wherein said interconnect means comprises a conductive pin disposed at a right angle between a first signal path on one of said circuit layers and a second signal path on another of said circuit layers.

5. The network as defined in claim 4 wherein said conductive pin comprises a recessed chamber formed in both ends thereof, each chamber having a springy conductive means compressed therein and forming a low-profile electrical contact with the associated conductive path.

6. The network as defined in claim 2 wherein each of said couplers has a variable overlapped line geometry which comprises:

a first transmission path formed on the top surface of said dielectric board; and a second transmission path formed on the bottom surface of said dielectric board and at least partially overlapping said first transmission path so as to provide a high coupling ratio.

7. The network as defined in claim 6 wherein said first and second transmission paths include smoothly-tapered edges forming undulations so as to minimize internal electromagnetic reflections.

8. The network as defined in claim 2 wherein each of said phase shifters has a variable overlapped line geometry which comprises:

a first transmission path formed on the top surface of said dielectric board;

a second transmission path formed on the bottom surface of said dielectric board and offset from said first transmission path;

a conductive member electrically coupled between said first and second transmission paths; and mode suppression means including a conductive shell at least partially surrounding said conductive member and coupled to said ground plane so as to terminate unwanted modes of electromagnetic wave propagation.

9. The network as defined in claim 8 wherein said conductive element comprises a conductive ribbon.

10. The network as defined in claim 8 wherein said first and second transmission paths include smoothly-tapered edges forming undulations so as to enhance high frequency operations.

11. A low-profile multiple simultaneous microwave antenna modeforming network such as a Butler matrix which provides a multioctave frequency bandwidth and at least a ten-to-one ratio comprising:

input means coupled to a plurality of stacked circuit layers for receiving M mode control signals;

said plurality of stacked circuit layers having electrical circuitry, which includes a plurality of couplers and fixed phase shifters, said circuit layers each including a dielectric board having said circuitry, formed on top and bottom surfaces thereof;

first and second dielectric layers disposed on the top and bottom surfaces, respectively, of each of said circuit layers so as to provide tri-plate circuit layers;

a ground plane disposed between each of said tri-plate circuit layers;

interconnect means for providing electrical connections between said circuitry on different circuit layers; and output means coupled to said plurality of stacked circuit layers including N ports for feeding N elements of an antenna system.

12. The network as defined in claim 11 wherein each of said couplers has a variable overlapped line geometry which comprises:

a first transmission path formed on the top surface of said dielectric board; and a second transmission path formed on the bottom surface of said dielectric board and at least partially overlapping said first transmission path.

13. The network as defined in claim 12 wherein said first and second transmission paths include smoothly-tapered edges forming undulations so as to minimize internal electromagnetic reflections.

14. The network as defined in claim 11 wherein each of said phase shifters has a variable overlapped line geometry which comprises:

a first transmission path formed on the top surface of said dielectric board;

a second transmission path formed on the bottom surface of said dielectric board and offset from said first transmission path;

a conductive ribbon electrically coupled between said first and second transmission paths; and mode suppression means including a conductive shell at least partially surrounding said conductive ribbon and coupled to said ground plane so as to terminate unwanted modes of electromagnetic wave propagation.

15. The network as defined in claim 14 wherein said first and second transmission paths include smoothly-tapered edges forming undulations so as to enhance high frequency operations.

16. The network as defined in claim 11 wherein said interconnect means comprises a conductive pin which contacts circuitry of one of said circuit layers at a substantially right angle and further contacts circuitry of a second of said circuit layers at a substantially right angle.

17. The network as defined in claim 16 wherein said conductive pin comprises a recessed chamber formed in both ends thereof, each chamber having a springy conductive means compressed therein and forming a low-profile electrical contact with the associated conductive path.

18. The network as defined in claim 11 wherein said electrical circuity on each of said plurality of circuity layers comprises single layer microwave stripline circuit traces which do not overlap one another on any given surface.

19. A method for forming a low-profile stripline microwave matrix feed network with a multioctave frequency bandwidth comprising:

forming a plurality of circuit layers, each circuit layer having a dielectric board with electrical circuitry, formed on top and bottom surfaces thereof and having single layered circuit traces formed in an offset coupled arrangement;

coupling input means to said plurality of stacked circuit layers for receiving M feed control signals;

disposing each of said circuit layers between first and second dielectric layers to form tri-plate circuit layers;

stacking said tri-plate circuit layers so one layer is above another layer;

forming conductive ground planes between each of said tri-plate circuit layers so as to provide stripline circuitry;

forming electrical right angle interconnects between selected circuitry, located on different circuit layers; and coupling output means to said plurality of stacked circuit layers for communicating with N feed elements.

20. The method as defined in claim 19 wherein said electrical circuitry, includes:

a plurality of couplers;

a plurality of phase shifters; and transmission lines interconnecting said circuitry.

* * * * *